US011420349B2

(12) United States Patent
Iaccarino

(10) Patent No.: US 11,420,349 B2
(45) Date of Patent: Aug. 23, 2022

(54) HAIR CLIPPER COMPRISING A COMB

(71) Applicant: KONINKLIJKE PHILIPS N.V., Eindhoven (NL)

(72) Inventor: Luca Iaccarino, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 22 days.

(21) Appl. No.: 16/652,696

(22) PCT Filed: Oct. 3, 2018

(86) PCT No.: PCT/EP2018/076884
§ 371 (c)(1),
(2) Date: Apr. 1, 2020

(87) PCT Pub. No.: WO2019/068746
PCT Pub. Date: Apr. 11, 2019

(65) Prior Publication Data

US 2020/0238547 A1 Jul. 30, 2020

(30) Foreign Application Priority Data

Oct. 4, 2017 (EP) ..... 17194660

(51) Int. Cl.
*B26B 19/20* (2006.01)
*B26B 19/38* (2006.01)
*B26B 19/06* (2006.01)

(52) U.S. Cl.
CPC ..... *B26B 19/20* (2013.01); *B26B 19/3826* (2013.01); *B26B 19/06* (2013.01)

(58) Field of Classification Search
CPC ..... B26B 19/00; B26B 19/02; B26B 19/04; B26B 19/06; B26B 19/20; B26B 19/205;
(Continued)

(56) References Cited

U.S. PATENT DOCUMENTS 3,149,418 A 9/1964 Milbourne
4,138,809 A * 2/1979 Pires ..... B26B 19/20 30/200

(Continued)

FOREIGN PATENT DOCUMENTS

CN 202445393 9/2012
EP 1510304 3/2005

(Continued)

OTHER PUBLICATIONS

International Search Report and Written Opinion dated Dec. 18, 2018 for International Application No. PCT/EP2018/076884 Filed Oct. 3, 2018.

(Continued)

*Primary Examiner* — Jason Daniel Prone

(57) ABSTRACT

This application concerns a comb (200) for a hair clipper comprising a comb portion (208) comprising a plurality of comb teeth (216) having slots formed there between for guiding hairs to a cutting element of the hair clipper. The comb portion may be configured such that, when the comb is attached to the hair clipper, a substantially wedge-shaped hair debris-receiving space is formed between the housing and the comb portion into which hair debris can flow. The comb teeth may comprise an extension portion (230) which extends generally forwardly away from the respective comb tooth in a cutting movement direction such that a connecting bar is spaced apart from a housing of the hair clipper by a greater distance than the plurality of comb teeth.

19 Claims, 9 Drawing Sheets

(58) Field of Classification Search
CPC . B26B 19/38; B26B 19/3806; B26B 19/3813; B26B 19/3826
USPC ..... D28/54; 30/194–202, 208–216, 233.5
See application file for complete search history.

(56) References Cited

U.S. PATENT DOCUMENTS

| | | | | | |
|---|---|---|---|---|---|
| 4,776,095 | A * | 10/1988 | Tsujimoto | B26B 19/20 | 30/201 |
| 4,845,852 | A * | 7/1989 | Sukow | B26B 19/20 | 30/201 |
| 5,050,305 | A * | 9/1991 | Baker | B26B 19/20 | 30/201 |
| 5,084,974 | A * | 2/1992 | Sukow | B26B 19/20 | 30/201 |
| 5,185,931 | A * | 2/1993 | Fujikawa | B26B 19/20 | 30/201 |
| 5,259,115 | A * | 11/1993 | Bluder | B26B 19/20 | 30/201 |
| D393,103 | S * | 3/1998 | Ullmann | D28/54 | |
| 5,979,060 | A * | 11/1999 | Holzbauer | B26B 19/20 | 30/200 |
| 6,279,234 | B1 | 8/2001 | Chaouachi | | |
| D463,623 | S * | 9/2002 | Kling | D28/54 | |
| 6,618,948 | B2 * | 9/2003 | Lin | B26B 19/20 | 30/233.5 |
| 6,968,623 | B2 * | 11/2005 | Braun | B26B 19/20 | 30/201 |
| 7,921,566 | B2 * | 4/2011 | Yamaguchi | B26B 19/06 | 30/233.5 |
| D637,760 | S * | 5/2011 | Tasar | D28/53 | |
| D651,747 | S * | 1/2012 | Nitsch | D28/53 | |
| D767,207 | S * | 9/2016 | Dekliein | D28/54 | |
| 9,833,914 | B2 * | 12/2017 | Sobagaki | B26B 19/205 | |
| 10,105,856 | B2 * | 10/2018 | Tuijp | B26B 19/06 | |
| 10,456,936 | B2 * | 10/2019 | Darwinkel | B26B 19/20 | |
| D881,471 | S * | 4/2020 | Zhang | D28/54 | |
| 10,661,459 | B2 * | 5/2020 | Vonk | B26B 19/06 | |
| D891,702 | S * | 7/2020 | Sanders | D28/54 | |
| 2006/0123633 | A1 * | 6/2006 | Hauer | B26B 19/20 | 30/201 |
| 2007/0204469 | A1 * | 9/2007 | Garic | B26B 19/20 | 30/201 |
| 2008/0066314 | A1 * | 3/2008 | Rapold | B26B 19/06 | 30/30 |
| 2008/0301948 | A1 * | 12/2008 | Kostner | B26B 19/063 | 30/199 |
| 2011/0107604 | A1 * | 5/2011 | Julemont | B26B 19/20 | 30/201 |
| 2016/0144518 | A1 * | 5/2016 | Zijlstra | B26B 19/3886 | 30/201 |
| 2016/0151923 | A1 * | 6/2016 | Sisson | B26B 19/3813 | 30/201 |
| 2018/0222068 | A1 * | 8/2018 | Halmut | B26B 19/20 | |
| 2018/0345510 | A1 * | 12/2018 | Julemont | B26B 19/20 | |
| 2020/0094425 | A1 * | 3/2020 | Iaccarino | B26B 19/20 | |
| 2021/0008739 | A1 * | 1/2021 | Iaccarino | B26B 19/20 | |
| 2021/0008740 | A1 * | 1/2021 | Iaccarino | B26B 19/20 | |
| 2021/0122070 | A1 * | 4/2021 | Iaccarino | B26B 19/20 | |

FOREIGN PATENT DOCUMENTS

| | | |
|---|---|---|
| EP | 2055449 | 5/2009 |
| EP | 2581180 | 4/2013 |
| JP | H0382496 | 4/1991 |
| WO | 2005/108021 | 11/2005 |
| WO | 2008/099281 | 8/2008 |
| WO | 2015/184585 | 12/2015 |
| WO | 2017/021202 | 2/2017 |
| WO | 2018210766 | 11/2018 |

OTHER PUBLICATIONS

Written Opinion of the International Preliminary Examining Authority dated Sep. 2, 2019 for International Application No. PCT/EP2018/076884 Filed Oct. 3, 2018.

International Preliminary Report on Patentability dated Dec. 17, 2019 for International Application No. PCT/EP2018/076884 Filed Oct. 3, 2018.

* cited by examiner

HAIR CLIPPER COMPRISING A COMB

CROSS REFERENCE TO RELATED APPLICATIONS

This application is the U.S. National Phase application under 35 U.S.C. § 371 of International Application No. PCT/EP2018/076884 filed Oct. 3, 2018, published as WO 2019/068746 on Apr. 11, 2019, which claims the benefit of European Patent Application Number 17194660.1 filed Oct. 4, 2017. These applications are hereby incorporated by reference herein.

FIELD OF THE INVENTION

The present application concerns combs for hair clippers and hair clipper apparatus comprising combs.

BACKGROUND OF THE INVENTION

Hair clippers are used for trimming hair. The cutting element of a hair clipper usually comprises a pair of comb-like blades which rapidly slide back and forth relative to each other in order to cut hairs positioned between the teeth of the blades with a scissor-like action. Clippers enable large numbers of hairs to be cut in a single stroke.

In order to guide hairs to the cutting element, hair clippers are sometimes provided with a comb which lifts and guides hairs as the hair clipper is moved over the skin. The comb can also comprise a skin guide portion which contacts the skin and can be used to provide a predetermined spacing between the skin and the cutting element in order to define a remaining length of the hairs after cutting.

A problem with such combs for hair clippers is that, configurations of the comb which most effectively lift and guide hairs can also cause cut hair debris to clog the comb, thereby reducing cutting efficiency. Accordingly, it would be desirable to provide a comb for a hair clipper which reduces the tendency of cut hair debris to clog the comb.

SUMMARY OF THE INVENTION

In a first aspect, there is provided a hair clipper comprising: a comb portion configured to be arranged forward of a cutting element of the hair clipper in a cutting movement direction of the hair clipper, the comb portion comprising a plurality of comb teeth having slots formed there between for guiding hairs to be cut to the cutting element, wherein the comb portion is configured such that, when the comb is attached to the hair clipper, a spacing between the comb teeth and a housing of the hair clipper increases with distance away from the cutting element so as to form a substantially wedge-shaped hair debris receiving space between the housing and the comb portion into which hair debris can flow.

The comb according to the first aspect provides a hair-receiving space between the housing and the comb for receiving hair debris after the hairs have been trimmed. The increasing size of the hair-receiving space with distance away from the cutting element provides an unobstructed outflow path for hair debris. In some cases, hair debris may change orientation as it moves away from the cutting element and otherwise become stuck and clog the comb, so the comb of the first aspect provides increasing space for hairs to freely flow out of the comb as they move away from the cutting edge.

The shape of the hair receiving space may also promote easy removal of hair debris, such as by gentle shaking or tapping, in the event that the comb does become clogged, as the hair has more space to be re-arranged and thereby become unclogged. Furthermore, the increasing size of the space may inhibit hair debris from becoming densely packed near the cutting element, which might otherwise be difficult or time consuming to remove.

The hair clipper may be any type of hair trimming device, such as a hair trimmer or beard trimmer. The comb may be a guide comb for lifting and guiding hairs to a cutting element of the hair clipper. The comb may comprise a skin guide portion for contact and sliding movement over the skin of a user during hair trimming. A gap may be provided between the skin guide and comb portions for the cutting element of the hair clipper.

The cutting direction of the hair clipper may be a direction in which the clipper must be moved in order to cut hair most effectively. The cutting element may comprise one or more comb-like blades having blade teeth. The cutting direction may be the direction in which the blade teeth point, or a direction in which the clipper must be moved in order to move hairs between the blade teeth points for cutting. The comb portion must be at least partially forward of the cutting element. The hair clipper housing may comprise a front housing surface arranged adjacent the cutting element and which faces generally forward in the cutting direction during use of the clipper. The comb portion may be arranged forward of the front housing surface in the cutting direction.

The comb teeth may be substantially identical. The comb teeth may be arranged with a contact spacing there between across a width of the comb portion. The comb teeth may be connected to a connecting bar at an end of the comb teeth ultimate the cutting element in use. The comb teeth may be unsupported at any other location than the connecting bar. An end of the comb teeth proximate the cutting element in use may be free to move. The comb portion may further comprise one or more frame elements arranged to support the connecting bar and connect the comb portion to the skin guide portion or the clipper. First and second frame elements may be arranged on first and second sides of the comb and the comb portion. The connecting bar may extend between the two frame elements across a width of the comb. The comb teeth may be arranged between the two frame elements.

The spacing between the comb teeth and the housing may be a distance between the comb teeth and the housing. The spacing may be a distance between the comb teeth and the housing measured in the cutting direction. The spacing may vary along a height of the comb portion. The spacing may be measured between the front housing surface and the comb teeth and, in particular, between the front housing surface and a rear edge of the comb teeth. The spacing between the frame elements and the housing may or may not be substantially identical to the spacing of the comb teeth.

The distance away from the cutting element may be measured along a height of the comb portion. Accordingly, the spacing between the comb teeth and the housing decreases with decreasing distance from the cutting element along the comb teeth. The spacing may not be constant across a width of the comb at a given distance from the cutting element (or given height on the comb portion). For example, the comb portion could be arced forward or backward in the cutting direction across the width of the comb when viewed from above, or the spacing angle between the comb teeth and the housing may vary across a width of the comb portion. However, it will be understood that, at any given width across the comb portion, the spacing between the comb teeth and the housing at that width will increase with increasing distance from the cutting element. Therefore, while the shape of the receiving space may not be constant or identical across the width of the comb, it should be understood that the receiving space has a substantially wedge shape in any given plane taken across its width. The wedge-shaped receiving space may additionally or alternatively be described as a tapered receiving space, in the sense that the space tapers in depth towards the cutting element.

Hair debris may refer to cut hair debris or hair particles which have been cut by the cutting element.

The height of the comb portion may be measured in a direction substantially perpendicular to the plane of the skin when the clipper is in use. The depth of the comb, or part thereof may be measured in the cutting direction. The width of the comb or part thereof may be measured in a direction across the comb when viewed along the cutting direction.

The first spacing angle is formed between the comb teeth and the housing of the hair clipper such that the spacing between the comb teeth and the housing increases with distance away from the cutting element. The spacing may increase substantially linearly with distance away from the cutting element. The first spacing angle may be around 10 to 30 degrees, optionally 10-15 degrees and may be around 15 degrees. The first spacing angle may vary across a width of the comb portion.

Rear edges of the comb teeth, which face the housing of the hair clipper in use, define a first rear comb surface proximate the cutting element in use and a second rear comb surface ultimate the cutting element in use. The first spacing angle is formed between the first rear comb surface and the housing, and a second spacing angle may be formed between the second rear comb surface and the housing. The first and second rear comb surfaces may be substantially planar, or may be curved across a width of the comb.

The second spacing angle may be larger than the first spacing angle. The second spacing angle may be smaller than the first spacing angle. The second spacing angle may be around 10 degrees to around 50 degrees, around 30 degrees to around 50 degrees, and may be around 45 degrees. The second spacing angle may vary across a width of the comb portion.

The comb is an adjustable comb for adjusting a cutting length of the hair clipper. The length of the first rear comb surface may be equal to or greater than a cutting length range of the hair clipper.

The comb comprises adjustment features defining a length adjustment direction of the comb, the length adjustment direction may substantially parallel to the first rear comb surface, such that a gap between the comb teeth and the cutting element in use is substantially constant for all cutting lengths in the cutting length range. In some examples, the length adjustment direction may be misaligned with the first rear comb surface by an angle less than a predetermined angle, such that a gap between the comb teeth and the cutting element in use remains below a predetermined limit for all cutting lengths in the cutting length range. The predetermined angle may be less than 20 degrees, less than 10 degrees, or less than 5 degrees. The predetermined limit may be 10 mm, 8 mm, 6 mm, 4 mm, or 2 mm.

In a second aspect, there is provided a hair clipper comprising: a comb portion configured to be arranged forward of a cutting element of the hair clipper in a cutting movement direction of the hair clipper, the comb portion comprising a plurality of comb teeth having slots formed there between for guiding hairs to be cut to the cutting element, wherein two or more of the comb teeth comprise an extension portion which extends generally forwardly away from the respective comb tooth in the cutting movement direction; and wherein a connecting bar connects the two or more comb teeth together within their respective extension portions, such that, in use, the connecting bar is spaced apart from a housing of the hair clipper by a greater distance than the plurality of comb teeth.

The comb according to the second aspect provides connecting bar which is spaced apart from the housing by a greater distance than the comb teeth. Thus, the slots defined between the comb teeth may be substantially unobstructed along their length. The slots may also be open at an end ultimate the cutting element, where the connecting bar would otherwise be located in prior art systems. Accordingly, cut hair debris may pass along the slots and out of the end of the slots. Accordingly, clogging of the comb may be reduced.

Furthermore, the connecting bar being spaces away from the housing may enable hair debris, and in particular longer hair debris, to pivot about the connecting bar to be oriented more appropriately for free-flow out of the comb. Accordingly, the present comb may reduce clogging at high hair cut delta lengths (i.e. length difference of the remaining hair before and after cutting) such that the hair clipper can be used to cut longer hair, and thereby enable hair cutting to occur less frequently without clogging issues.

The extension portion may be a portion of the respective comb tooth which extends at an angle to a main part of the comb tooth.

The extension portion is a portion of the comb tooth having an increased depth in the cutting movement direction compared to a remainder of the comb tooth.

The extension portion of the comb teeth may be configured to be ultimate the cutting element of the hair clipper in use.

The connecting bar may be spaced apart from the rear edges of the comb teeth by a greater distance than a depth of the comb teeth such that the slots formed between the comb teeth are open at the ends of the slots ultimate from the cutting element in use.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE DRAWINGS

Embodiments will now be described by way of example only, with reference to the Figures, in which.

DETAILED DESCRIPTION OF EMBODIMENTS

Figure 1:
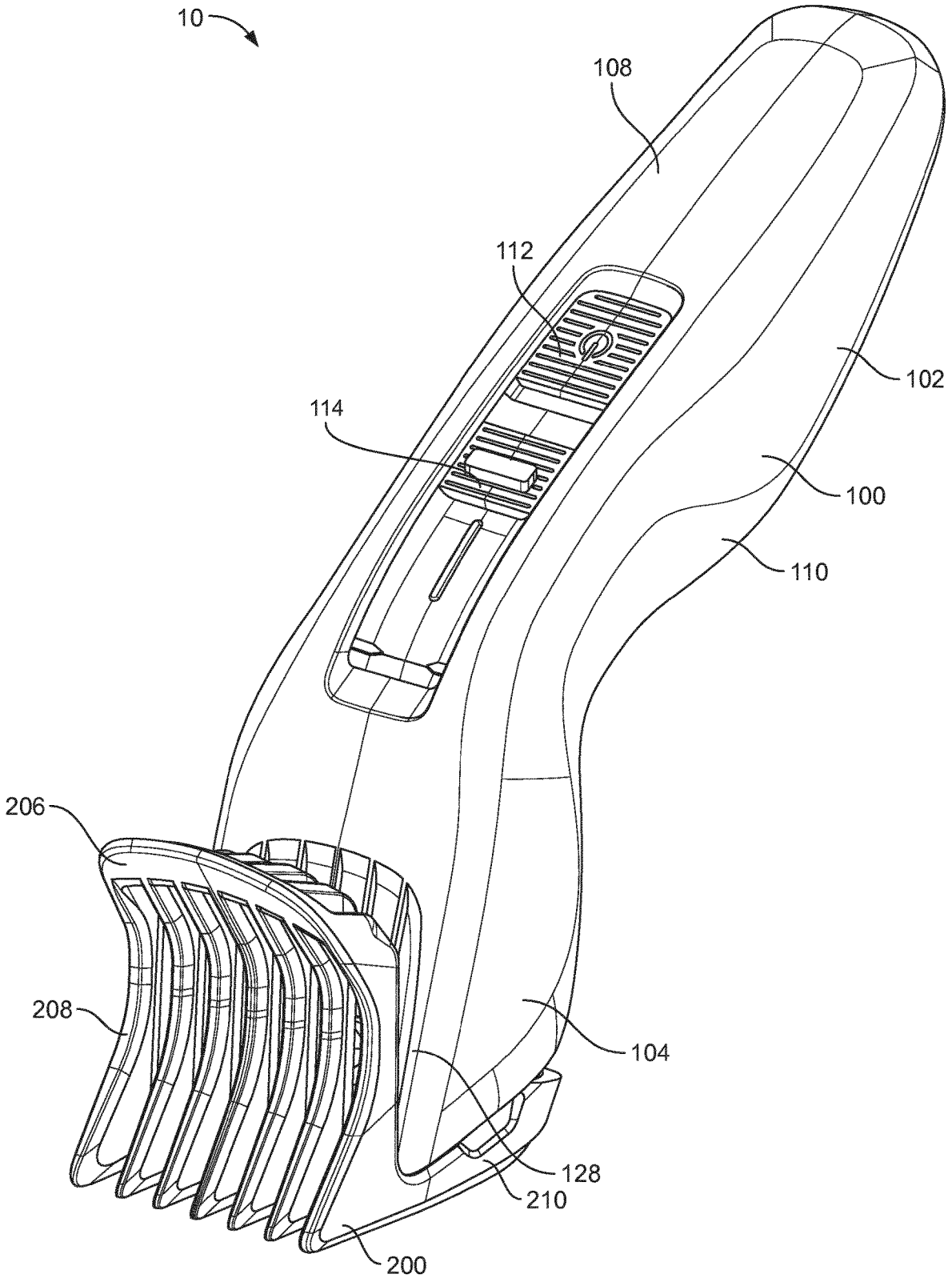
FIG. 1 is a perspective view of a hair clipper apparatus comprising a hair clipper and a comb.

Referring to FIGS. 1-5, there is generally shown a hair clipper apparatus 10 comprising a hair clipper 100 and a comb 200.

The hair clipper 100 comprises an elongate grippable body 102 having a cutting head 104 on which a cutting element 106 is arranged and a handle portion 108 which generally extends away from the cutting head 104. The clipper body 102 is generally formed by a housing 109 which forms the external surface of the clipper body 102.

The handle portion 108 is an elongate grippable portion by which a user can grip the clipper 100 with their hand during use. The handle portion 108 is partially covered with a rubberized or textured surface 110 to facilitate better gripping of the clipper 100 by a user, particularly when the handle portion 108 is wet. On a front face of the handle portion 108, a power button 112 and a cutting length adjustment switch 114 are provided for powering the clipper 100 on/off and adjusting a cutting length of the clipper 100 respectively.

The cutting head 104 is arranged at an end of the handle portion 108 such that, when the handle portion 108 is gripped by a user, the cutting head 104 extends out of the user's fist. The cutting head 104 comprises the cutting element 106 of the clipper. Referring also to FIG. 6, the cutting element comprises a first static blade 116 and a second reciprocating blade 118. The blades 116,118 combine to form a cutting edge 117. Each of the blades 116,118 has a forward edge formed of a plurality of blade teeth 120 which can be seen best in FIGS. 4 and 5. The reciprocating blade 118 is reciprocated laterally relative to the static blade 116 in a direction parallel to the cutting edge 117, such that hairs positioned between the blade teeth 120 are cut with a scissor-like action as the blade teeth 120 move past one another. The reciprocating blade 118 may be moved using a motor 120 which powers a reciprocating mechanism 123 attached to the blade 118. The motor 122 may be powered by a rechargeable battery 124 contained within the housing 109 of the clipper 100. The motor 122 can be selectively turned on and off using the power switch 112.

The cutting edge 117 forms a front edge of the cutting head 104, which defines a cutting direction x of the hair clipper 100. It should be understood that in order for hairs to easily enter the gaps between the blade teeth 120, they must approach the cutting edge 117 from in front, and therefore, the hair clipper 100 cuts hair most effectively when moved forwards in the cutting direction x.

The external surface 126 of the cutting head which is rearward of the cutting edge 117 in the cutting direction x is a skin facing surface 126. In use, for a close shave without the comb 200 attached to the clipper 100, the skin-facing surface 126 is generally pressed lightly against the user's skin, and the clipper is slid, while contacting the user's skin, in the cutting direction, such that the cutting edge 117 moves forward along the user's skin in the cutting direction x, thereby cutting hairs it encounters.

The part of the hair which is cut off by the cutting element 106, which will be referred to as hair debris or debris, will be located on a first side of the cutting edge adjacent a front face 128 of the clipper housing 109, while the part of the hair remaining attached to the skin will move past the cutting edge in the cutting direction, remaining in contact with the skin-facing surface 126.

The front-facing housing surface 128 is part of the clipper housing 109. The front housing surface 128 extends at a large acute angle, around 60 degrees, to the skin-facing surface 126 and generally meets the skin-facing surface 126 at the cutting edge 117. In use, the front housing surface 128 generally extends away from the user's skin above the cutting edge 117. The front housing surface is substantially planar across a majority of the width of the clipper housing 109.

Figure 3:
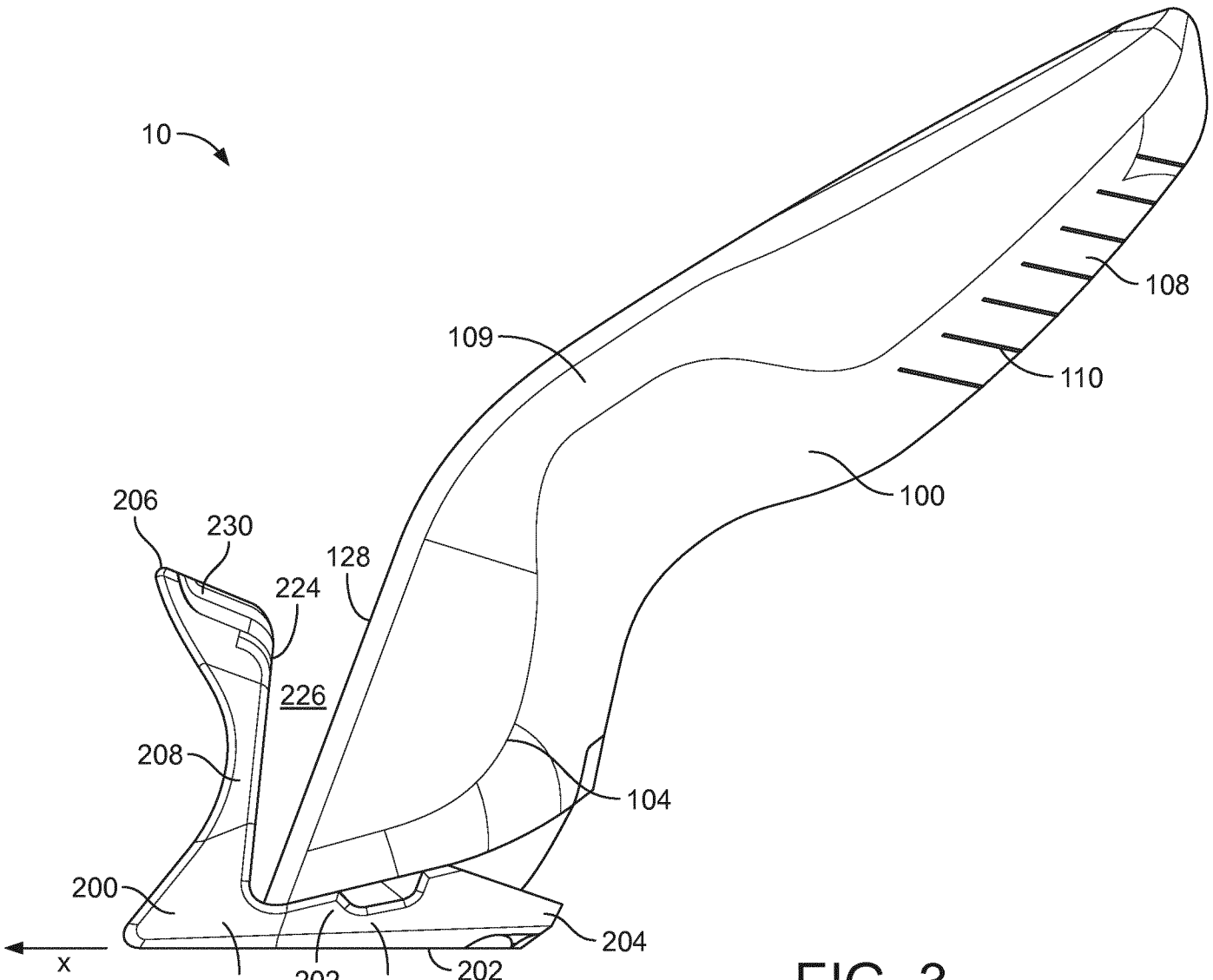
FIG. 3 is a side view of the hair clipper apparatus of FIG. 1.
Figure 4:
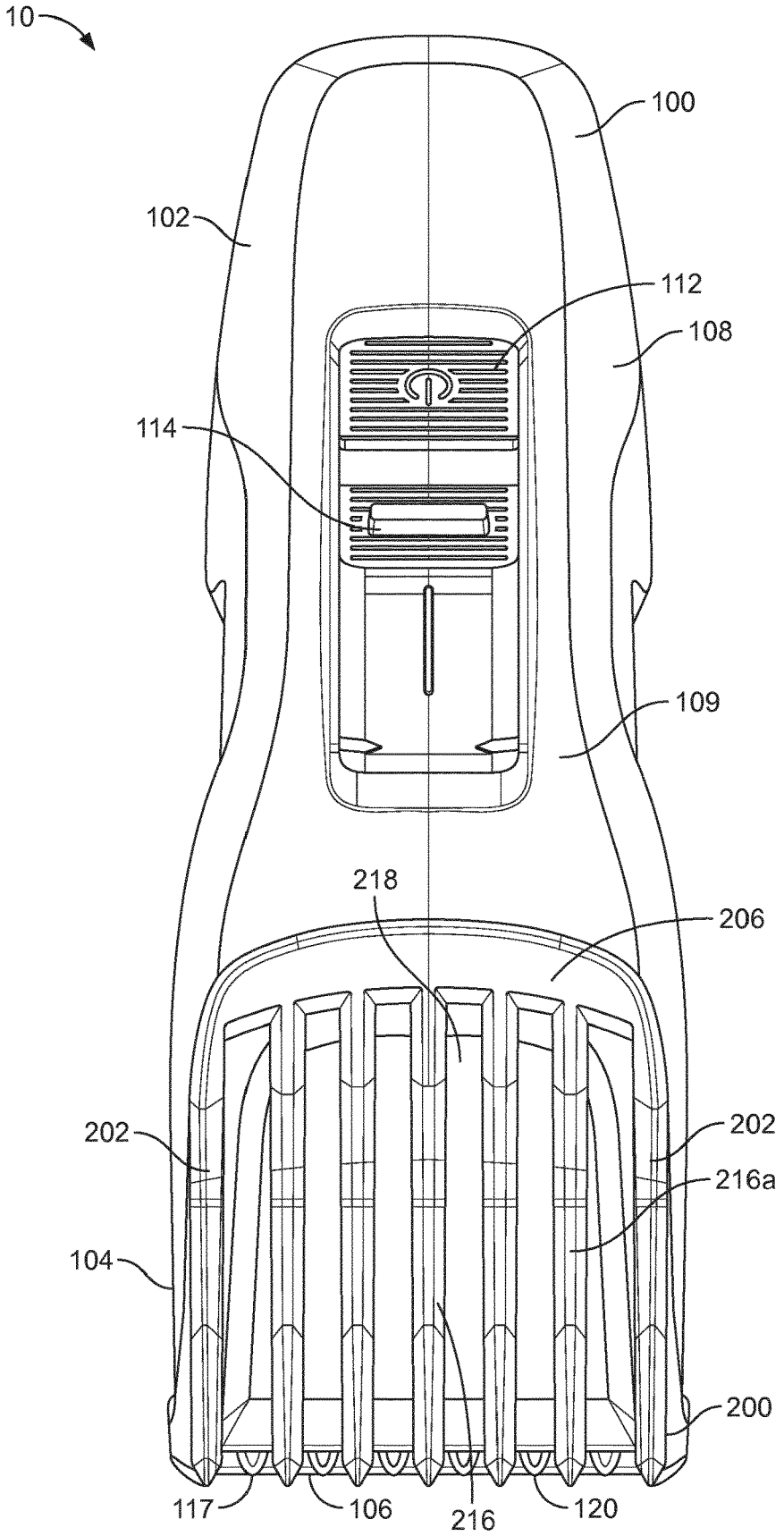
FIG. 4 is a front view of the hair clipper apparatus of FIG. 1.

In this example, a plurality of recessed debris guiding chutes 130 are provided on the clipper housing 109 in the front surface 128. The debris chutes 130 are formed between plurality of non-recessed elongate ribs 132 which are flush with and form part of the front surface 128. The ribs 132 are each parallel and extend perpendicular to the cutting edge 117 along the front surface 128 such that the debris chutes 130 are formed between the ribs 132 and extend in substantially the same direction. The debris chutes 130 may provide better removal of hair debris. In some cases, the debris chutes 130 and ribs 132 may not be provided and the front surface 128 may be substantially continuous. Despite the discontinuities in the front surface 128 in the illustrated example, it should be understood that the front surface 128 of the housing 109 is generally the front-most surface of the housing 109 of the hair clipper and is generally planar as shown in FIG. 3 or 6, for example.

Figure 2:
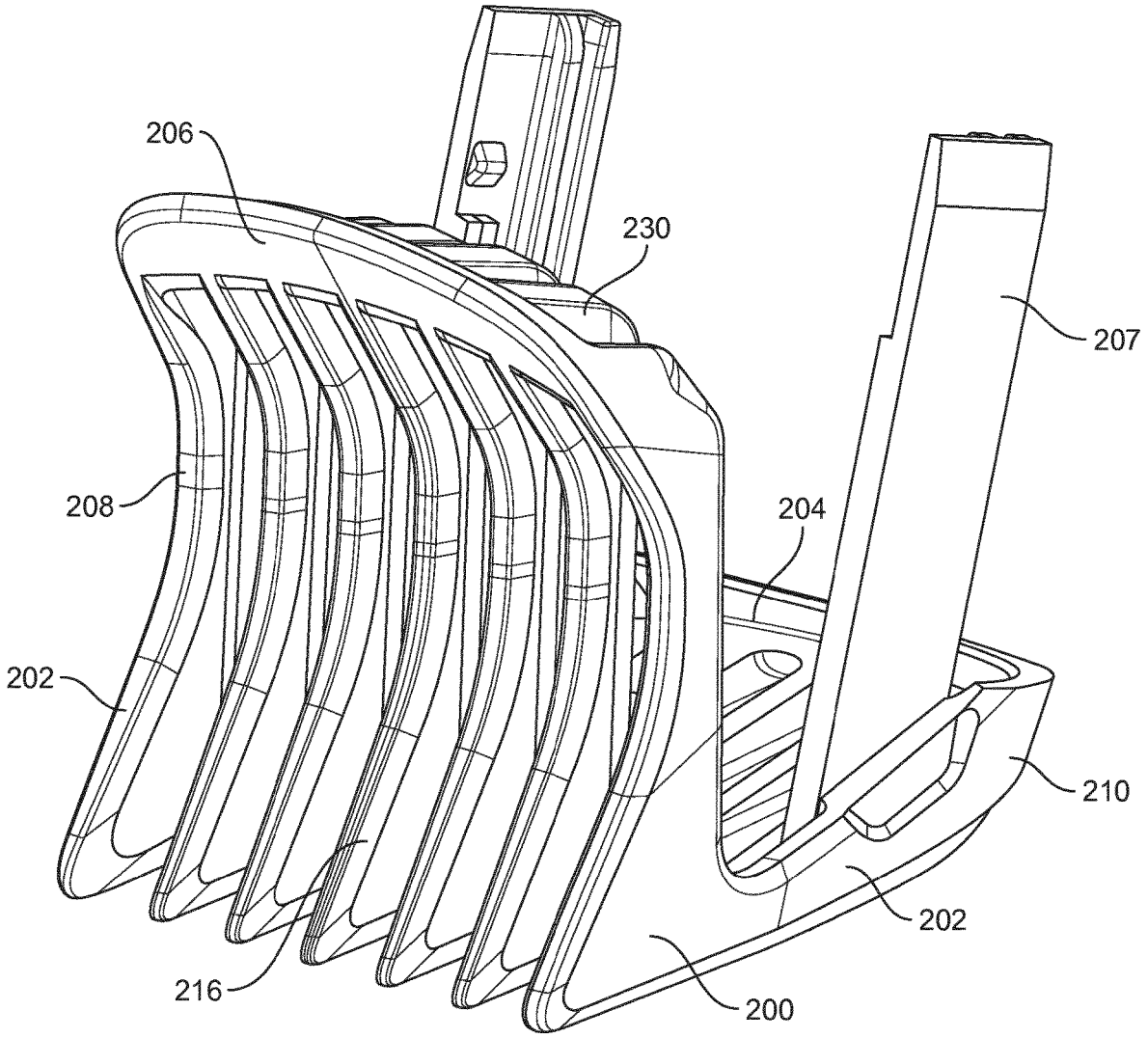
FIG. 2 is a is a perspective view of the comb of FIG. 1.

The apparatus 10 also comprises a comb 200, as best illustrated in FIG. 2. The comb 200 generally guides and lifts hairs to be cut so that the cutting element 106 can cut them most effectively and efficiently.

The comb 200 comprises two generally L-shaped side frame elements 202. The frame elements 202 are connected together and spaced apart by a rear connecting bar 204 and a front connecting bar 206. The two arms of the L-shaped frame elements 202 form a comb portion 208 and a skin guide portion 210. In this example, the frame elements 202 are shaped such that skin guide portion 210 is attached to the base of the comb portion 208 at the base of the comb portion 208. In other examples, the frame elements 202 may connect the skin guide portion 210 to the comb portion 208 at another location, for example at an upper or middle location on the comb portion 208, such that the base of the comb 200 provides an open space at the areas to the sides of the cutting element 106. The distance between the frame elements 202 (and the axial length of the connecting bars 204, 206) is substantially equal to the width of the cutting head 104 of the clipper 100 such that the comb 200 can be mounted on the cutting head 104 between the frame elements 202.

An adjustment feature in the form of an adjustment rail 207 extends from each of the frame elements 202 in the skin guide portion 210. The adjustment rails 207 are insertable into corresponding slots in the clipper 100 for attaching the comb 200 to the clipper. In order to adjust a cutting length of the clipper 100, the adjustment switch 114 can be moved to extend or retract the comb 200 by moving the adjustment rails 207 out of or in to the clipper 100. Accordingly, the adjustment rails, which are substantially straight and linear define an adjustment direction along which the comb moves when a length adjustment is made.

The skin guide portion 210 generally conforms to the skin facing surface 126 of the clipper 100 such that, when the comb 200 is attached to the clipper 100, the skin guide portion overlies the skin-facing surface 126. An outer surface of the skin guide portion 210 is a skin contact surface 212 for contacting the skin in use when the comb 200 is attached to the clipper 100. Thus, when the skin contact surface 212 is in contact with the skin, the skin facing surface 126 is spaced apart from the skin-contact surface 212 (and consequently the skin) by at least a depth of the skin guide portion 210.

The rear connecting bar 204 is formed at a rearward edge skin guide portion 210, as best seen in FIG. 6. A plurality of elongate guides 214 extend forwardly from the rear connecting bar in the cutting direction. The guides 214 taper towards their forward end ultimate the rear connecting bar 204 such that, when the comb 200 is attached to the clipper 100, the distance y between the skin facing surface 126 and the skin contact surface 212 decreases in the cutting direction x away from the rear connecting bar 204, or increases with distance away from the cutting element 106.

The comb portion 208 is arranged generally perpendicular to the skin guide portion 210 and forward of the cutting element and the housing 109 in the cutting direction x. A comb cutting zone 215 is generally defined proximate the meeting point of the comb portion 208 and the skin guide portion 210 at between the corners of the L-shaped frame elements 202. In use, the comb cutting zone 215 is generally arranged proximate the cutting element 106 of the clipper 100.

The front connecting bar 206 extends between the frame elements 202 at an end of the comb portion 208 which is ultimate the cutting element 106 in use. A plurality of comb teeth 216 extend from the connecting bar 206 towards the cutting zone 215. The comb teeth 216 have equal thickness (i.e. across a width of the comb 200) and are generally equally spaced across the width of the connecting bar 204. In other examples, the teeth 216 may not be equally spaced. The comb teeth 216 also generally extend in parallel directions such that a plurality of slots 218 are formed between the comb teeth 216 themselves and between the outer-most comb teeth 216*a* and the frame elements 202.

The comb teeth 216 and the slots 218 generally extend along the comb portion 208 away from the cutting zone 215 and the cutting element 106. More generally, they extend away from and perpendicular to the skin in use.

As will be best understood with reference to FIG. 6, each of the comb teeth 216 and the frame elements 202 in the comb portion 208 have a front edge 220 which generally faces forwards in the cutting direction x, and a rear edge 222 which generally faces backwards in the cutting direction. The rear edges 222 of the comb teeth 216 and the frame elements 202 in combination define a rear comb surface 224 which generally forms a rearmost face of the comb portion 208. The rear comb surface 224, it will be understood, is not a continuous solid surface, but is a generally a plane defined by and occupied by the rear edges 222. It could also be said that the rear comb surface is s discontinuous surface defined by the rear edges 222. As can be seen in FIG. 6, the rear comb surface 224 is generally planar, although it may also be curved.

As can be seen in FIG. 6, a spacing between the comb teeth 216 and the housing 109, and in particular the front surface 128, increases with increasing distance from the cutting element 106, such that substantially wedge-shaped space 226 is formed between the housing 109 and the comb portion 208. After a hair is cut, the debris will flow between the teeth 216 and into the wedge shaped space 226. As increasing debris is cut and enters the space 226, the debris will flow out of the space 226 owing to the increased spacing between the comb portion 208 and the housing 109.

In the example of FIGS. 1-6, the rear comb surface 224 and the front housing surface 128 are both substantially planar, such that a spacing angle θ is formed between the two surfaces when the comb 200 is attached to the clipper 100. In this particular example, the angle θ may be 15 degrees. Accordingly, the spacing distance between the rear comb surface 224 and the front housing surface 128 increases linearly with increasing distance away from the cutting element 106. Of course, in other examples, one or both of the surfaces 224, 128 may be curved or non-planar and the space 226 may still form a substantially wedge-shape.

Figure 6:
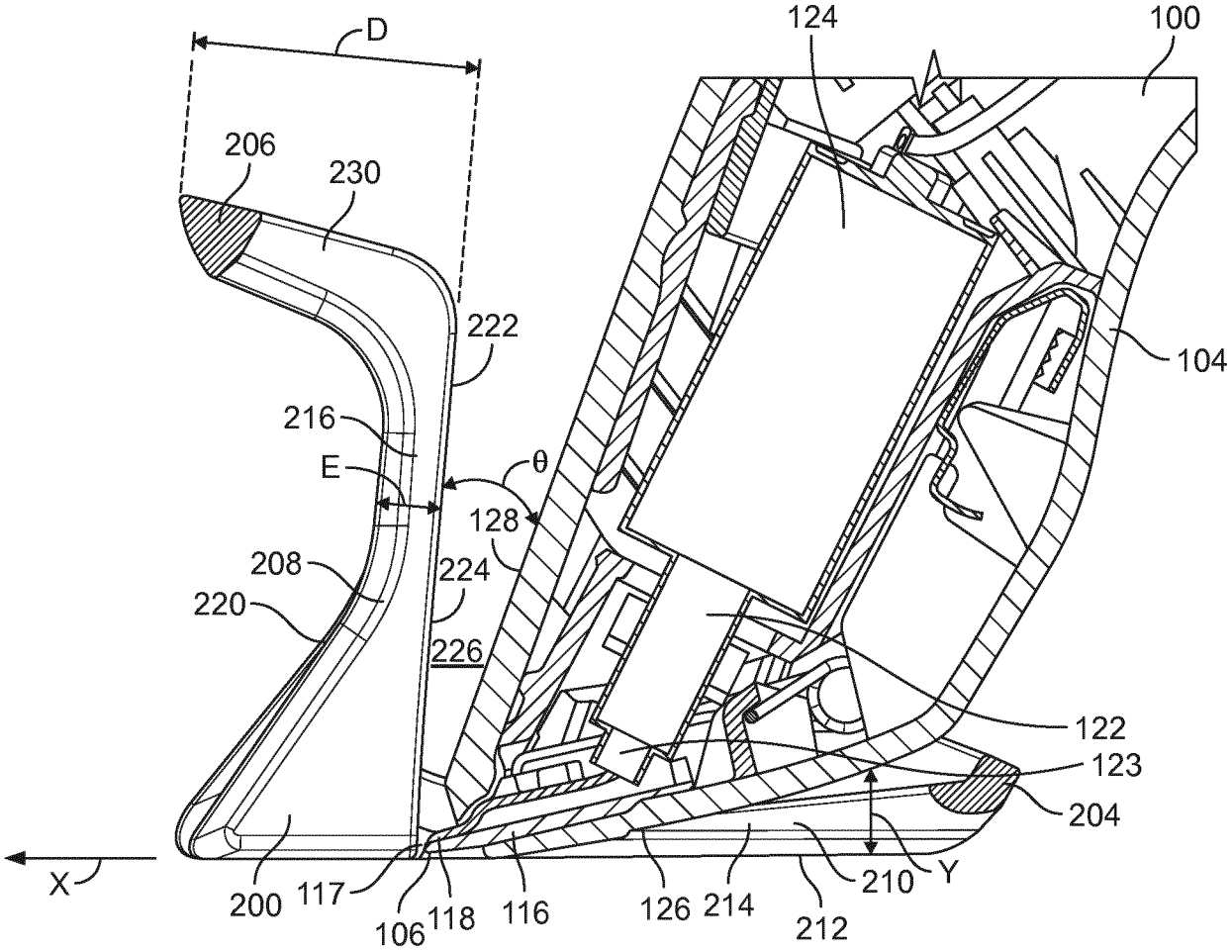
FIG. 6 is a sectional side view of a portion of the hair clipper apparatus of FIG. 1 taken along the line A-A.
Figure 6A:
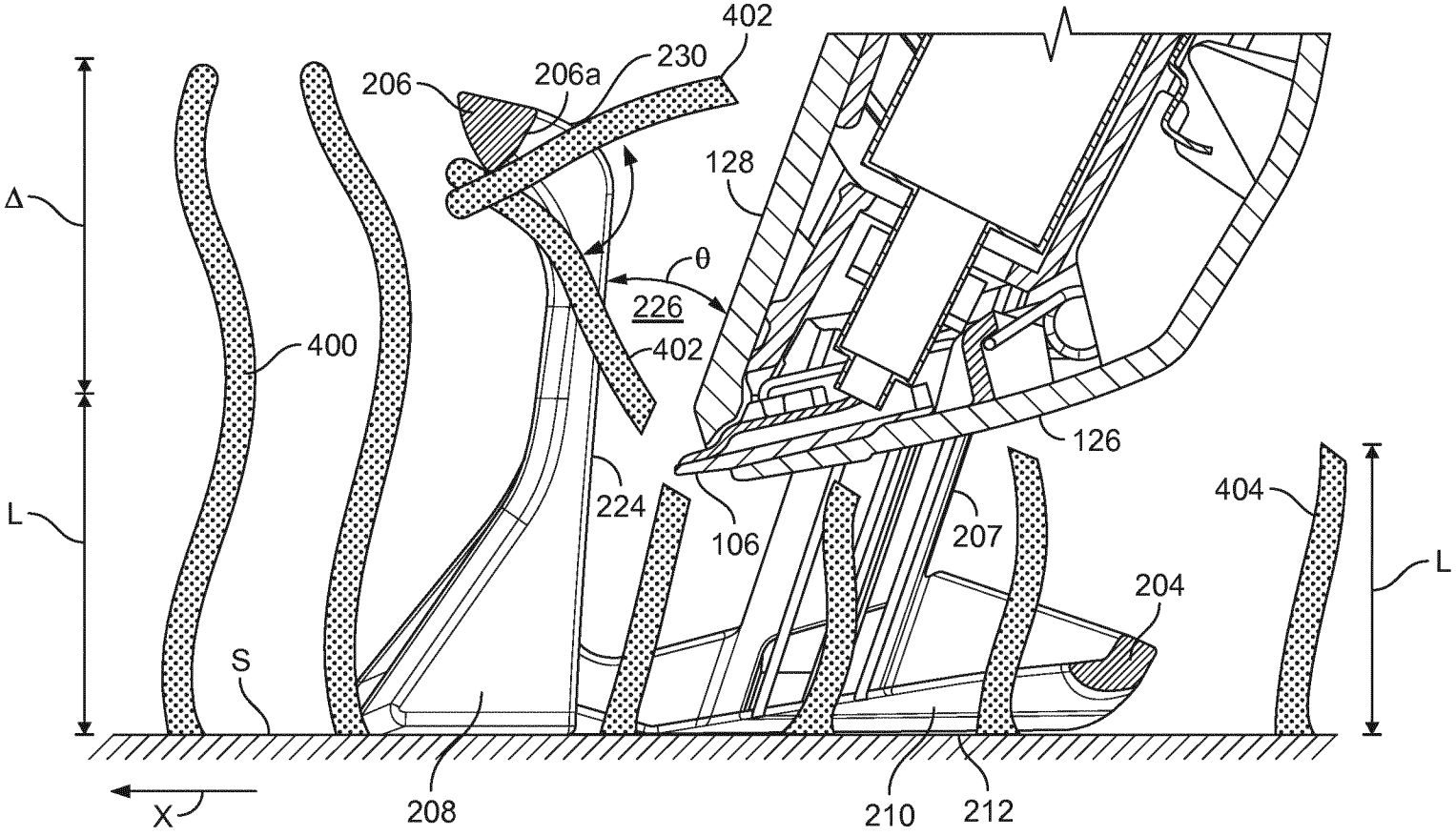
FIG. 6A is a sectional side view of the hair clipper apparatus of FIG. 1 with the comb extended.

As shown in FIG. 6A, the comb 200 can be adjusted by extending the adjustment rails 207 further from the clipper 100 to thereby extend the cutting length of the clipper apparatus 10. It will be understood that, by extending the comb 200 from the clipper by a greater distance, a distance between the cutting element 106 and the skin S is increased, as the skin guide portion 210 of the comb contacts the skin S prevents the skin S from being any closer to the cutting element. The distance between the cutting element 106 and the skin S will define a cut length L of hairs after they have been cut.

Figure 7:
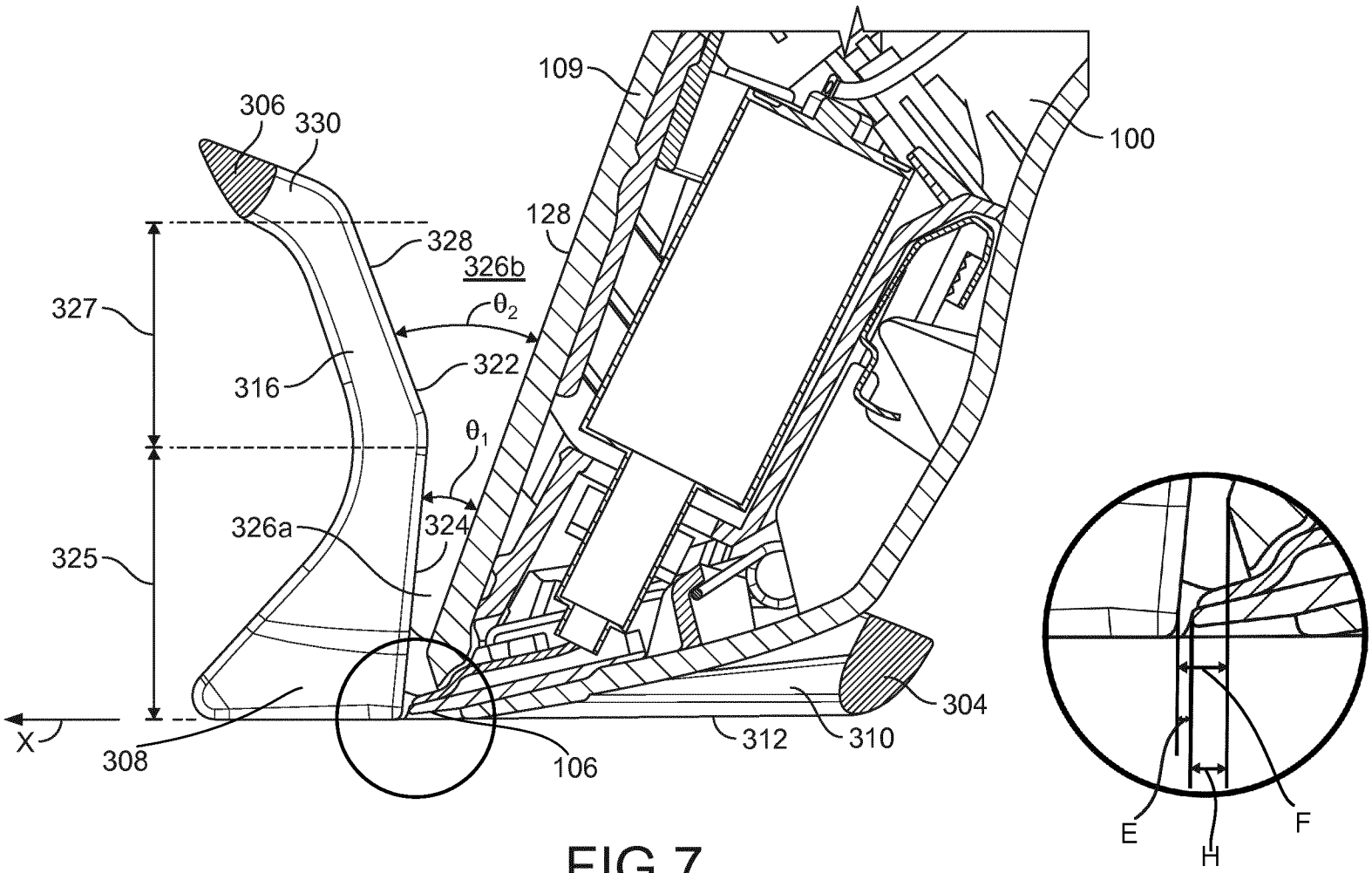
FIG. 7 is a sectional side view of a hair clipper apparatus having an alternative comb.

A further example of a comb 300 is shown in FIG. 7. Like features between the comb 200 and the comb 300 are indicated by reference numerals differing by 100.

In this example, the comb portion 308 comprises a first portion 325 which, in use, is proximate the cutting element 106, and a second portion ultimate the cutting element 106. Accordingly, the frame elements 302 and the comb teeth 316 each have corresponding first and second portions proximate and ultimate the cutting element 106 in use.

The rear edges 322 of the comb teeth 316 and the frame elements 302 in the first portion 325 in combination define a first rear comb surface 324 which generally forms a rearmost surface or plane of the first portion 325 of the comb portion. As with the rear comb surface 224, it will be understood that the first rear comb surface 324 is not a continuous solid surface, but is a generally a plane defined by and occupied by the rear edges 322.

Furthermore, the rear edges 322 of the comb teeth 316 and the frame elements 302 in the second portion 327 in combination define a second rear comb surface 328 which generally forms a rearmost surface or plane of the second portion 327 of the comb portion. As with the rear comb surface 224 and the first rear comb surface 324, it will be understood that the second rear comb surface 328 is not a continuous solid surface, but is a generally a plane defined by and occupied by the rear edges 322.

The first and second rear comb surfaces 324 and 328 are generally planar in this example, although they may not be in other examples. The first rear comb surface 324 extends in a first direction such that a first spacing angle θ1 is formed between the housing 109 (in particular the front housing surface 128) and the first rear comb surface 324 in the same manner as described for the comb 200 above. However, in the comb 300, the second portion 327 of the comb 300 is angled yet further away from the housing such that a second spacing angle θ2 is formed between the second rear comb surface 328 and the housing 109 (and in particular the front housing surface 128).

Accordingly the wedge-shaped hair debris receiving space 326 is formed of a first wedge 326*a* formed between the first rear comb surface 324 and the housing 109, and a second wedge 326*b* formed between the second rear comb surface 328 and the housing 109. In this example, the first spacing angle θ1 is smaller than the second spacing angle θ2 such that rate of increase of the spacing between the rear comb surfaces 324, 328 and the housing 109 is greater in the second portion 327 than the first portion 325. Of course, in other examples, the first spacing angle θ1 may be larger than the second spacing angle θ2. The comb 300 yet further promotes the easy flow of hair debris out of the space 326, as the spacing or distance between the comb portion 308 and the housing 109 increases substantially with distance away from the cutting element 106 owing to the increased spacing angle θ2 in the second portion of the comb. In this example, the first spacing angle θ1 may be around 15 degrees and the second spacing angle θ2 may be around 45 degrees. These angles may be particularly effective at avoiding clogging of the comb.

As shown in the inset detailed view of the encircled portion proximate the cutting element 106 in FIG. 7, a gap F is defined between the comb rear surface 324 and the front housing surface 128. The gap F enables cut hair to flow between the comb portion 308 and the housing 109. A distance H is defined from the cutting element 106 to the front housing surface 128. A distance E is defined from the comb rear surface 324 to the cutting element 106. It will be understood that the size of the gap F is related to distances E and H, such that F is equal to E+H.

The minimum size of gap F at the minimum length extension (of the comb 300) provided by the adjustment rails 307 is 3.5 mm. Therefore, the distances E and H sum to a minimum of 3.5 mm at the minimum length extension of the comb 300. It will be appreciated that the gap F could be larger than 3.5 mm at the minimum length extension of the comb 300. The distance E may have a minimum size of 1.5 mm, and the distance H may have a minimum size of 0.5 mm, although it will be appreciated that they may not both have their minimum size in the same example, in order to ensure that the gap F is at least 3.5 mm. It will be appreciated that there are many combinations of distances E and H which sum to a minimum of 3.5 mm.

Figure 7A:
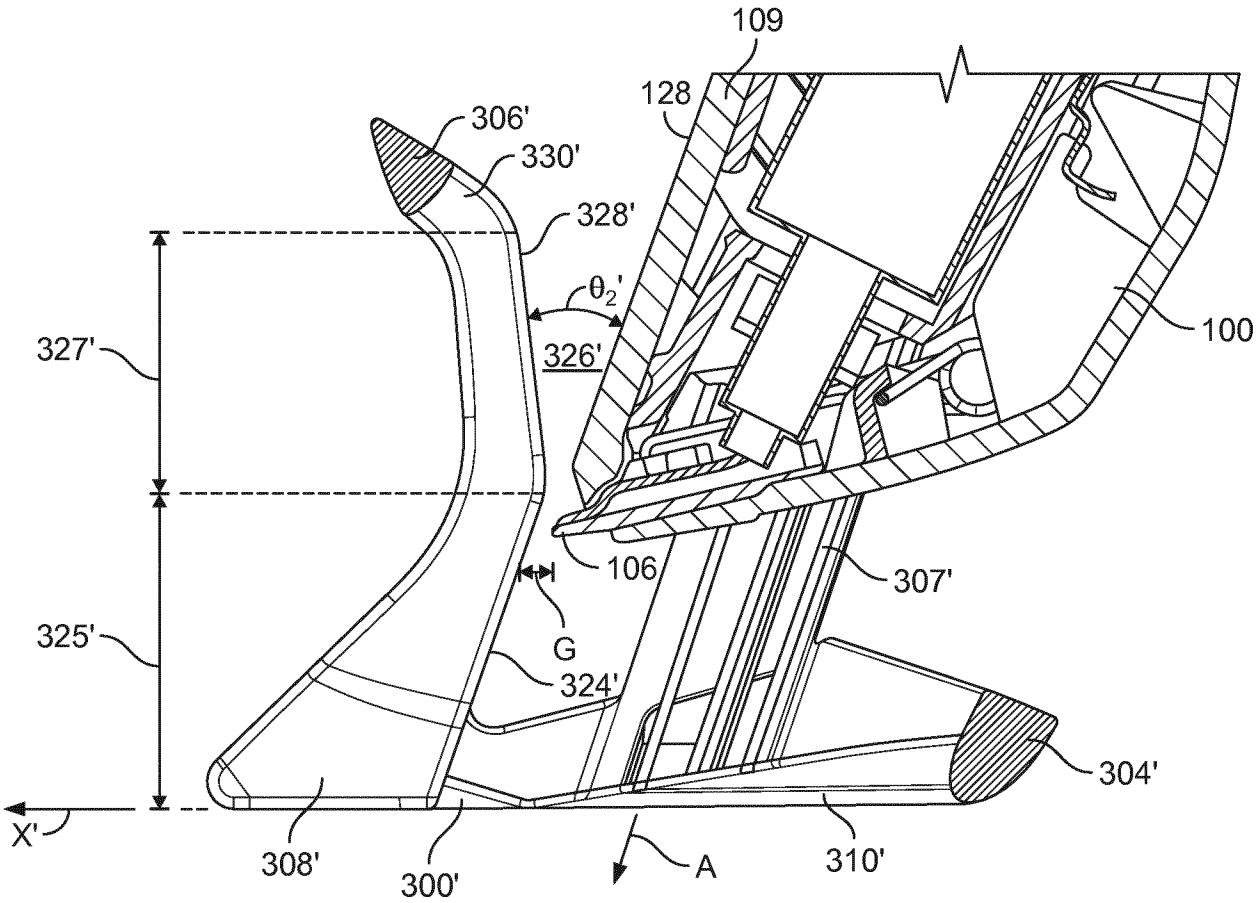
FIG. 7A is a sectional side view of a hair clipper apparatus having a further alternative comb in an extended position

A yet further arrangement of a comb 300' is shown in FIG. 7A Like features between the comb 300 and the comb 300' are shown with a ' appended to the reference numeral. In the illustrated position, the comb 300' is at a maximum length extension provided by the adjustment rails 307'.

In this example, the first rear comb surface 324' is formed such that it is parallel with an adjustment direction A defined by the adjustment rails 307'. Furthermore, the length of the rear comb surface 324' in the adjustment direction A is greater than the total length adjustment range provided by the adjustment rails 307', and even at maximum extension as shown in FIG. 7A.

Accordingly, a gap G formed between the cutting element 106 and the rear comb surface 324' has a substantially constant size regardless of the length adjustment required. Accordingly, the gap G can be controlled carefully in order to avoid the gap becoming too great, thereby increasing cutting effectiveness, as fewer hairs will fall between the comb portion 308' and the cutting element 106. As shown, the spacing angle θ2 between the second rear comb surface 328 and the housing 109 still provides a wedge-shaped space 326' to promote easy hair debris flow out of the comb 300'.

It should be understood that, in order to control the size of the gap G, the first rear comb surface 324' need not be exactly parallel to the adjustment direction A. For example, an angular deviation between the surface 324' and the direction A can be controlled to thereby control the increase in the size of the gap G as the comb 300' is extended. The angular deviation may be set at a certain maximum in order to provide an acceptable maximum size of the gap G when the comb 300' is fully extended.

The combs herein described also provide a further advantageous aspect as will be described below.

Figure 5:
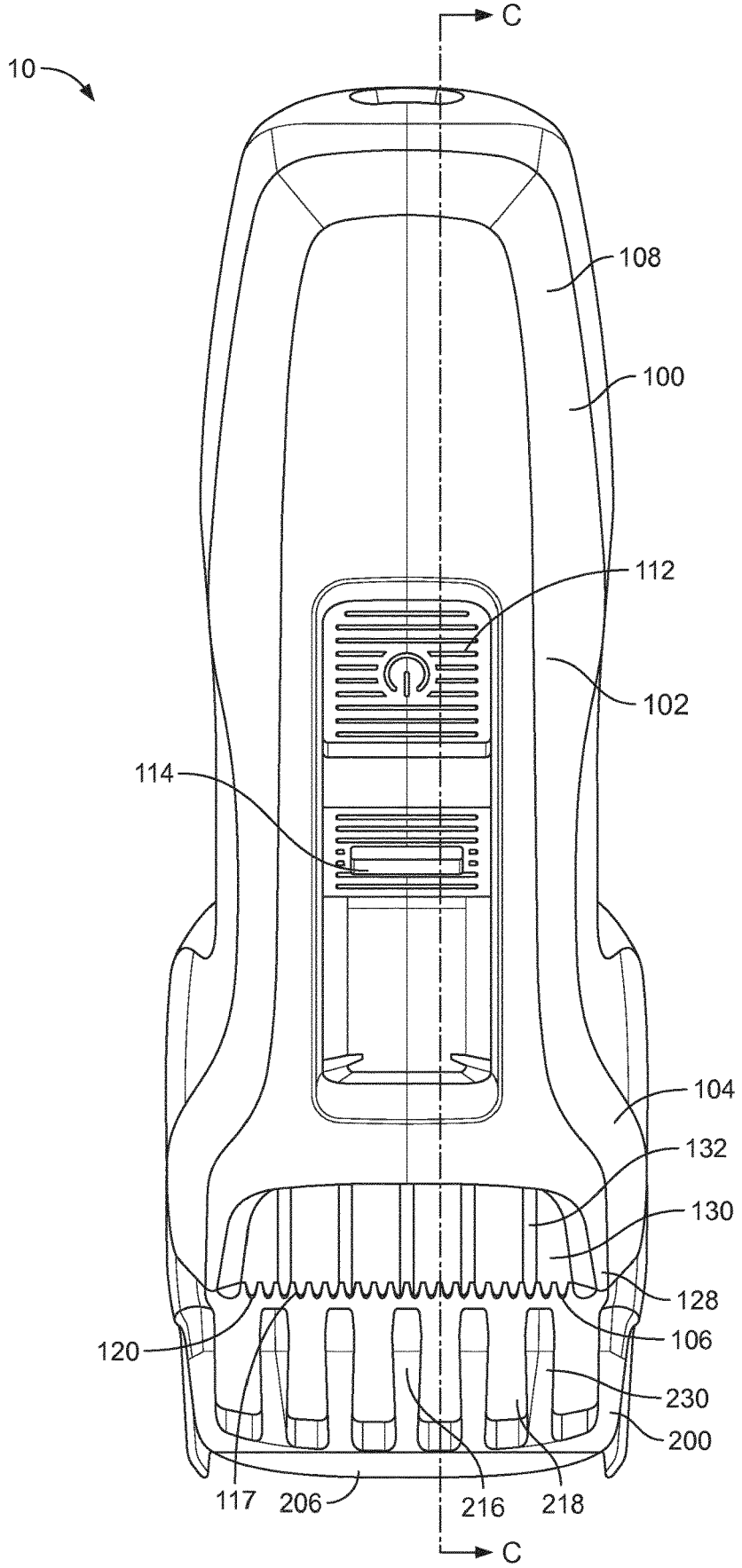
FIG. 5 is a plan view of the hair clipper apparatus of FIG. 1.

As can be best seen in FIGS. 5 and 6, the front connecting bar 206 is spaced apart from the housing 109 (and in particular the front housing surface 128 by a greater distance than the rest of the comb portion 208.

In order to provide this increased spacing, the comb teeth 216 and the frame elements 200 comprise an extension portion 230 which extends generally forwardly in the cutting direction x. The extension portions 230 extend forwardly from the rear faces 222 of the comb teeth 216 by a distance D which is greater than the depth E of the comb teeth.

The connecting bar 206 connects the comb teeth 216 and the frame elements 202 together within their respective extension portions 230 and in particular, at a portion thereof ultimate the housing 109 and the cutting element 106. Therefore, in use, the connecting bar 206 is spaced apart from a housing 109 of the hair clipper 100 by a greater distance than the plurality of comb teeth 216. It will also be understood that owing to the extension portions 230, the connecting bar 206 is spaced apart from the rear edges 222 of the comb teeth 216 by a greater distance than a depth E of the comb teeth 216

As best illustrated in FIG. 5, which is a plan view down the comb portion 208, the extension portions 230 provide the advantage that the slots 218 formed between the teeth 216 are substantially open at their upper ends ultimate the cutting element 106. Accordingly, hair debris travelling up along the slots 218 can easily flow out of the upper ends of the slots without being inhibited by the connecting bar 206.

In this example, the extension portions 230 are a portion of the respective comb tooth or frame element which extends at an angle to a main part of the comb tooth 216, or to the rear comb surface 224 of the comb portion 208. The extension portion 230 generally extends perpendicularly to the front housing surface 128 to maximize the spacing between the connecting bar 206 and the housing 109 over the length of the extension portion 230.

The extension portion 230 can also be thought of as a portion of the comb teeth 216 and frame elements 202 which has an increased depth D in the cutting movement direction compared to a depth E of the remainder of the comb portion (i.e. the comb teeth 216 and frame elements 202).

The arrangement of the connecting bar 206 at an increased distance from the housing 109 than a remainder of the comb portion 208 also provides a further advantage when a delta cutting length (i.e. when the change in hair length during cutting is particularly large, such as when there has been a long time between cuttings). This further advantage will be described with respect to FIG. 6A. In this example, the connecting bar 206 may be spaced from the housing 109 by a minimum distance of around 30 mm.

Before cutting, a hair 400 has a length equal to L+Δ, where L is the length of a cut hair 404 after cutting and Δ is the change in hair length before and after cutting or, in other words, the length of the hair debris 402 after cutting.

As illustrated in FIG. 6A, as the apparatus 10 is moved in the cutting direction x, hairs 400 are guided by the comb portion 208 towards the cutting element 106 to be cut. As hairs 440 are cut to leave cut hairs 404, the hair debris 402 will move upwardly in the slots 218.

The extension portions 230 of the comb portion 208 arrange the connecting bar 206 such that, for large Δ, the connecting bar 206 contacts the hair debris 402 near an ultimate end thereof. Accordingly, the hair debris 402 may be encouraged to pivot about the connecting bar 206 as shown in FIG. 6A to thereby flow easily out of the ends of the slots 218. Of course, if the hair debris 402 is shorter than a distance between the housing 109 and the connecting bar 206, then it will not interact with the connecting bar 206 and will simply flow into the debris receiving space 226 or out of the upper ends of the slots 218. Longer hair debris 402 may be more prone to clogging the comb portion 208, so the connecting bar 206 owing to the extension portions 230 may promote the pivoting of long hair debris 402 in order to inhibit clogging.

The connecting bar 206 may have an inner pivoting surface 206*a* which faces the housing and the space 226 and is rounded or curved. The hair debris 402 may generally contact the pivoting surface 206*a* and, due to the curvature of the surface 206*a*, be encouraged to pivot away and out of the comb portion 208 more effectively than compared to an angular or flat connecting bar surface.

Accordingly, the combs 200, 300, 300' described herein serve to generally inhibit or reduce clogging with hair debris by encouraging the flow of hair debris of all lengths out of the comb. It should be understood that the arrangement of the combs to provide the wedge-shaped space between the comb portion and the housing of the clipper, and the extension portions providing increased spacing of the connecting bar from the housing may be implemented separately or in combination dependent upon the application required. Both aspects of the invention may generally serve to reduce clogging, but in combination, they may provide particularly effective clogging prevention or reduction.

While the invention has been illustrated and described in detail in the drawings and foregoing description, such illustration and description are to be considered illustrative or exemplary and not restrictive; the invention is not limited to the disclosed embodiments.

The aspects and embodiments disclosed and described herein may be combined with features disclosed in the earlier-filed European patent application number EP17171051.0, the contents of which are hereby incorporated by reference. In particular, a distance or spacing between the comb teeth and housing could, in addition to the increased spacing with increasing distance from the cutting element disclosed herein, be varied along other dimensions or directions relative to the comb or comb portion. For example, the spacing between the comb portion and the housing could vary across the width of the comb, and in particular with comb teeth closer to the edges or sides of the comb portion being spaced from the housing to a greater degree than the comb teeth arranged in the middle or center of the comb portion.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A hair clipper apparatus comprising:

a hair clipper comprising an elongate grippable housing having a cutting head on which a cutting element is arranged; and a comb comprising length adjustment features configured to movably and detachably couple to the cutting head, the comb comprising:

a comb portion configured to be arranged forward of the cutting element of the hair clipper in a cutting movement direction of the hair clipper, the comb portion comprising a plurality of comb teeth having slots formed there between for guiding hairs to be cut to the cutting element, a connecting bar that connects two or more of the plurality of comb teeth together, such that the connecting bar is spaced apart from the housing of the hair clipper by a distance greater than a distance between the hair clipper and the plurality of comb teeth, wherein rear edges of the comb teeth, which face the housing of the hair clipper, define a rear comb surface proximate the cutting element, and wherein a substantially wedge-shaped hair debris-receiving space defining a spacing angle formed between the rear comb surface and a front surface of the housing into which hair debris can flow, wherein the wedge-shaped hair debris-receiving space increases with distance away from the cutting element, as defined by the spacing angle, wherein the comb is an adjustable comb for adjusting a cutting length of the hair clipper, and wherein a length of the rear comb surface is equal to or greater than a total length adjustment range defined by the length adjustment features, and wherein the length adjustment features are configured to guide the comb in a length adjustment direction within the total length adjustment range, and wherein the length adjustment direction is substantially parallel to the rear comb surface.

2. The hair clipper as claimed in claim 1, wherein the spacing angle (θ1) is around 10 to 30 degrees.

3. The hair clipper as claimed in claim 2, wherein the rear edges of the comb teeth further define a second rear comb surface ultimate the cutting element, such that a second spacing angle is formed between the second rear comb surface and the housing, wherein the second spacing angle is around 30 to 50 degrees.

4. The hair clipper as claimed in claim 3, wherein the second rear comb surface is curved across a width of the comb.

5. The hair clipper as claimed in claim 1, wherein the rear edges of the comb teeth further define a second rear comb surface distal the cutting element, such that a second spacing angle is formed between the second rear comb surface and the housing, wherein the second spacing angle is equal to the spacing angle.

6. The hair clipper as claimed in claim 5, wherein the second rear comb surface is planar and extending linearly from the first rear comb surface or angled relative to the rear comb surface.

7. The hair clipper as claimed in claim 1, wherein the rear edges of the comb teeth further define a second rear comb surface distal the cutting element, such that a second spacing angle is formed between the second rear comb surface and the housing, wherein the second spacing angle is larger than the first spacing angle.

8. The hair clipper as claimed in claim 1, wherein a minimum portion of the wedge-shaped hair debris-receiving space is 3.5 mm.

9. The hair clipper as claimed in claim 1, wherein the substantially wedge-shaped hair debris-receiving space is maintained along the total length adjustment range provided by the adjustable comb.

10. The hair clipper as claimed in claim 1, wherein the adjustment features of the comb are defined in part by one or more adjustment rails that couple to the cutting head.

11. The hair clipper as claimed in claim 1, wherein the rear comb surface is planar.

12. The hair clipper as claimed in claim 1, wherein the two or more of the comb teeth comprise an extension portion which extends generally forward away from the housing in the cutting movement direction; and wherein the connecting bar connects the two or more comb teeth together at the extension portion.

13. The hair clipper as claimed in claim 12, wherein the extension portions are is substantially perpendicular to the front surface of the housing of the hair clipper.

14. The hair clipper as claimed in claim 12, wherein the extension portion extends forwardly from a rear face of the comb teeth by a distance greater than the depth of the comb teeth.

15. The hair clipper as claimed in claim 12, wherein the extension portion is a portion of the comb tooth having an increased depth in the cutting movement direction compared to a remainder of the comb teeth.

16. A hair clipper apparatus comprising:

a hair clipper having a housing and a cutting element, and a comb, the comb comprising:

a comb portion configured to be arranged forward of the cutting element of the hair clipper in a cutting movement direction of the hair clipper, the comb portion comprising a plurality of comb teeth having slots formed there between for guiding hairs to be cut to the cutting element, wherein two or more of the comb teeth comprise an extension portion which extends generally forwardly away from the respective comb tooth in the cutting movement direction;

wherein a connecting bar connects the two or more comb teeth together within their respective extension portions, such that, the connecting bar is spaced apart from the housing of the hair clipper by a distance greater than a distance between the hair clipper and the plurality of comb teeth; and wherein the extension portion is a portion of the comb tooth having an increased depth in the cutting movement direction compared to a remainder of the comb tooth.

17. A hair clipper as claimed in claim 16, wherein the extension portion is a portion of the respective comb tooth which extends at an angle to a main part of the respective comb tooth.

18. A hair clipper as claimed in claim 16, wherein the extension portion of the comb teeth is configured to be ultimate the cutting element of the hair clipper in use.

19. A hair clipper as claimed in claim 16, wherein the connecting bar is spaced apart from the rear edges of the comb teeth by a greater distance than a depth of the comb teeth such that the slots formed between the comb teeth are open at ends of the slots ultimate from the cutting element.

* * * * *